US008539873B2

(12) United States Patent
Gonard et al.

(10) Patent No.: US 8,539,873 B2
(45) Date of Patent: Sep. 24, 2013

(54) STANDOFF BALLISTIC PROTECTION DEVICE

(75) Inventors: Ulric Gonard, Pouilly les Nonains (FR); François-Xavier Querry, Tarcenay (FR)

(73) Assignee: Nexter Systems, Roanne (FR)

( * ) Notice: Subject to any disclaimer, the term of this patent is extended or adjusted under 35 U.S.C. 154(b) by 15 days.

(21) Appl. No.: 13/311,060

(22) Filed: Dec. 5, 2011

(65) Prior Publication Data

US 2012/0144986 A1 Jun. 14, 2012

(30) Foreign Application Priority Data

Dec. 10, 2010 (FR) ..... 10 04827

(51) Int. Cl.
*F41H 5/00* (2006.01)
*F41H 7/02* (2006.01)

(52) U.S. Cl.
USPC ..... 89/36.08; 89/36.01; 89/918; 89/937

(58) Field of Classification Search
USPC ..... 89/36.01, 36.04, 36.07, 36.08, 36.09; 280/770; 296/190.03
See application file for complete search history.

(56) References Cited

U.S. PATENT DOCUMENTS

| | | | | |
|---|---|---|---|---|
| 3,983,832 | A * | 10/1976 | Kinder | 440/12.63 |
| 5,576,508 | A * | 11/1996 | Korpi | 89/36.01 |
| 8,006,606 | B1 * | 8/2011 | Petrosillo et al. | 89/36.07 |
| 2007/0180983 | A1 * | 8/2007 | Farinella et al. | 89/36.07 |
| 2009/0044694 | A1 * | 2/2009 | Allor et al. | 89/36.08 |
| 2009/0044695 | A1 * | 2/2009 | Benjamin et al. | 89/36.08 |
| 2009/0100999 | A1 * | 4/2009 | Marqueling | 89/36.08 |
| 2011/0113952 | A1 * | 5/2011 | Rosenwasser et al. | 89/36.02 |
| 2011/0232472 | A1 * | 9/2011 | Kellner et al. | 89/36.08 |
| 2012/0097020 | A1 * | 4/2012 | Hazan | 89/36.08 |
| 2012/0137866 | A1 * | 6/2012 | Gonard et al. | 89/36.08 |
| 2012/0152101 | A1 * | 6/2012 | Engleman et al. | 89/36.08 |

FOREIGN PATENT DOCUMENTS

| | | | |
|---|---|---|---|
| DE | 198 35 955 | A1 | 2/2000 |
| EP | 1 944 566 | A1 | 7/2008 |
| WO | WO 2009/064263 | A2 | 5/2009 |

OTHER PUBLICATIONS

"Warthog Unveiled," The Straits Times Raizor TV, Sep. 29, 2009, XP000002656365, URL:http://www.youtube.com/watch?v=26-oa-EpnFs.

Worldwide-defence.blogspot, Jun. 24, 2010, XP000002656366, URL:http://4.bp.blogspot.com/-iWfk3PUKctM/TfJeuBBwKrI/AAAAAAAAIBU/DZmcFsC0f2E/s1600/warthog_with_slat_armor_atv_all_terrain_vehicle_uk_british_armed_forces_03.jpg.

Search Report issued in French Patent Application No. FA 749370 dated Aug. 8, 2011 (with translation).

* cited by examiner

*Primary Examiner* — Bret Hayes
(74) *Attorney, Agent, or Firm* — Oliff & Berridge, PLC

(57) ABSTRACT

A standoff protection device intended to fully cover a door and incorporating at least one mobile panel hinged on hinges having an axis of rotation parallel to an axis of rotation of the door. The device incorporates at least one connecting rod linked to the door by a first pivot and to the mobile panel by a second pivot. The orthogonal projection of the axis of the second pivot in the plane of the door is located between the first pivot and the orthogonal projection in the plane of the door of the axis of the hinges of the mobile panel. The device incorporating a fixed standoff protective panel integral with the door. The fixed panel includes a first lateral edge extending beyond an external edge of the door parallel to its axis of rotation, and a second lateral edge contiguous with the mobile panel when the door is closed.

6 Claims, 5 Drawing Sheets

STANDOFF BALLISTIC PROTECTION DEVICE

BACKGROUND OF THE INVENTION

1. Field of the Invention

The technical scope of the invention is that of standoff ballistic protection devices to protect doors, and in particular doors of military vehicles.

2. Description of the Related Art

To protect military vehicles from projectiles and explosive devices attacking by means of hollow charges or shaped charges, ballistic protections are installed at a distance from the external walls of the vehicle. These protections are often termed "slats" and consist in placing gridding, parallel bars, or simple louvered panels or even netting at a distance of between 200 and 400 mm around the vehicle and possibly above the vehicle. The aim of this protection is to perturb the triggering of projectiles before they reach the vehicle itself.

These protections are also placed in front of the doors and access hatches of the vehicle. With respect to the doors, it is obvious that the protection should not hinder the door's opening and closing to allow the crew to enter or exit the vehicle, but above all the door protection must be able to be installed or removed by the crew, without the need for assistance of a person outside the vehicle, for the crew to be able to enter or exit autonomously.

For this, it is known to fix a standoff ballistic protection panel that is fastened to the vehicle door so that the protection follows all the movements of the door. This solution presents the major disadvantage of requiring a non-protected zone around the door to enable its opening and closing movements. In other terms, this solution causes an absence of protection in proximity to the door hinges, this in order to be able to pivot the door without the protection fastened to the door interfering with the protection elements fastened to the vehicle and placed close by.

Patent EP1944566 discloses a standoff protection device surrounding a vehicle. This device incorporates hinges at the joining point of each panel that enable the protection panels to fold with respect to one another in a similar way to the bellows of an accordion. This way of folding the panels provides access to the vehicle's side doors from the exterior.

We see that this solution is not totally satisfactory since, from the inside of the vehicle, the crew is not able to open or close the panel placed facing the door.

A vehicle is also known (the Warthog) that is provided with protection covering the front doors and incorporating a panel hinged on hinges and driven by a connecting rod linked to the door. In this device the protective panel is not integral with the door and the level of protection provided is not sufficient.

SUMMARY OF THE INVENTION

To overcome the problem of the full ballistic protection of the door, as well as that of the opening of the protection from the inside of the vehicle, the invention proposes to ensure the protection of all or part of the door by a mobile panel mounted on hinges and associated with a fixed panel integral with the door. The movements of the door are communicated to the mobile panel by a connecting rod.

This connecting rod is arranged so as to ensure a satisfactory distance to avoid any interferences between door and panel whilst preserving the degree of freedom of the door and the panel.

The invention relates to a standoff protection device intended to fully cover a door and incorporating at least one mobile panel hinged on hinges having an axis of rotation parallel to an axis of rotation of the door, device wherein it incorporates at least one connecting rod intended to link the door to the mobile panel, connecting rod linked to the door by a first pivot and linked to the mobile panel by a second pivot, the orthogonal projection of the axis of the second pivot in the plane of the door being intended to be located between the first pivot and the orthogonal projection of the axis of the hinges of the mobile panel in the plane of the door, the mobile panel being furthermore intended to be positioned facing the axis of rotation of the door, device incorporating a fixed standoff protective panel integral with the door, fixed panel of which a first lateral edge extends beyond an external edge of the door parallel to its axis of rotation, and of which a second lateral edge is contiguous with the mobile panel when the door is closed.

According to one characteristic of the invention, the distance between the first pivot and the axis of rotation of the door is substantially equal to the distance between the second pivot and the axis of rotation of the hinges of the mobile panel.

Advantageously, the panel placed facing unlocking means for the door incorporates an access hatch for these unlocking means.

According to one characteristic of the invention, the distance between the axis of rotation of the door and the orthogonal projection in the plane of the door of the axis of rotation of the hinges of the mobile panel is greater than the distance separating the mobile panel from the door.

BRIEF DESCRIPTION OF THE DRAWINGS

The invention will become more apparent from the following description made with reference to the appended drawings, in which.

DETAILED DESCRIPTION OF PREFERRED EMBODIMENTS

Figure 1:
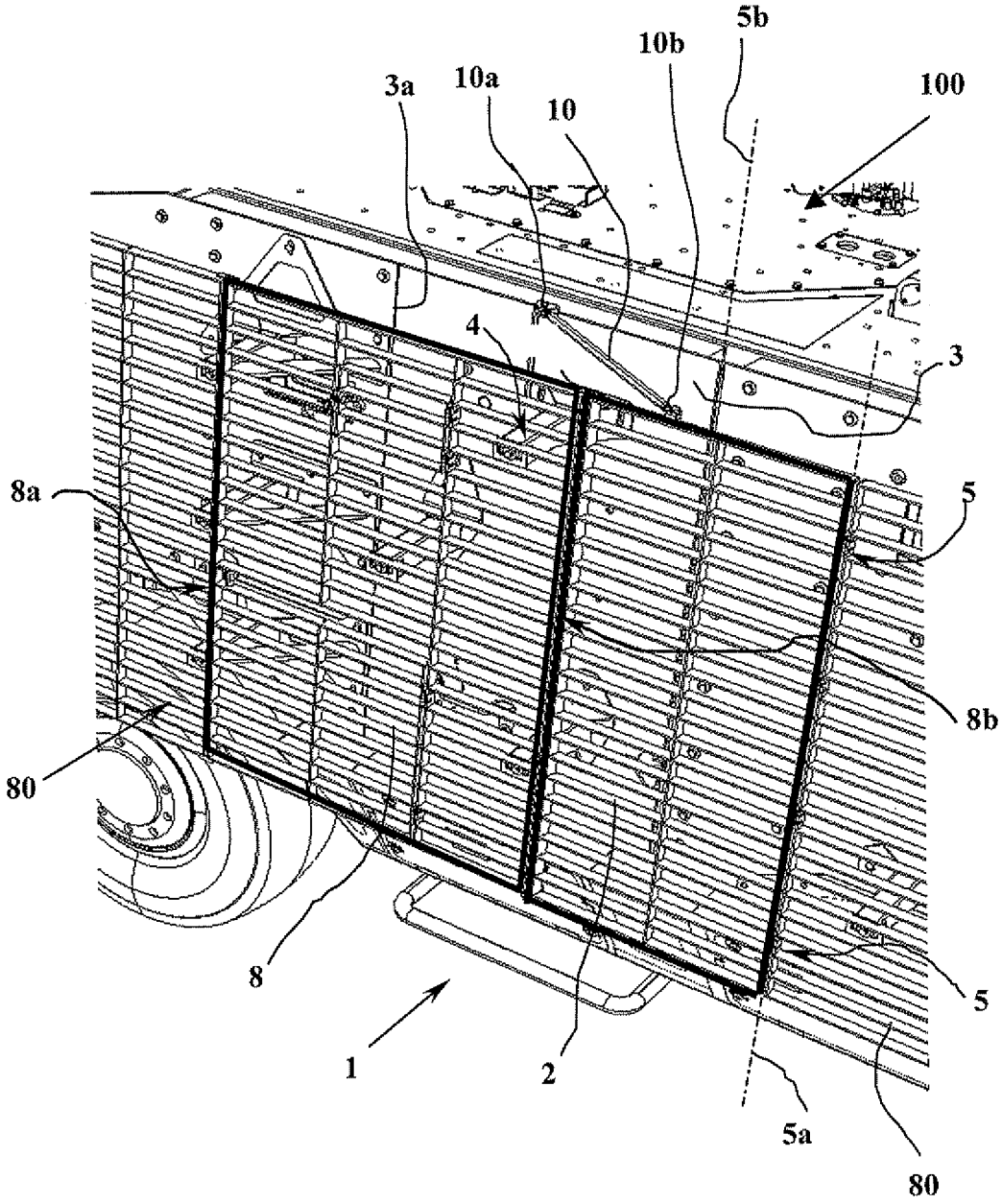
FIG. 1 shows a partial three-quarter top view of an armored vehicle, doors closed, equipped with a protection device according to a first embodiment of the invention.

With reference to FIG. 1, an armored vehicle 100 incorporates a stand-off protection device 1. This device incorporates slatted panels 80 placed on the side of the vehicle and substantially covering the circumference of the vehicle.

Figure 2:
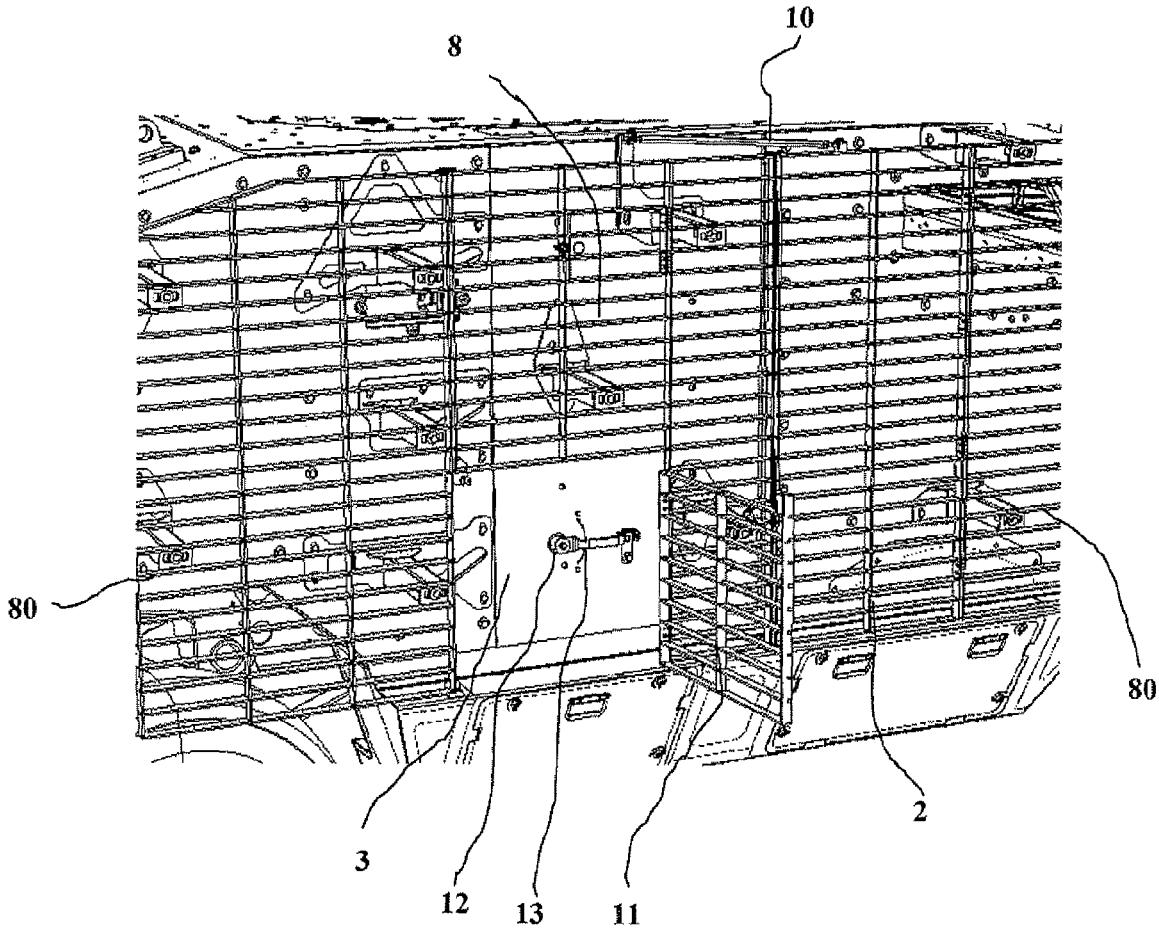
FIG. 2 shows a right side view of an armored vehicle equipped with this first embodiment of the protective device.
Figure 3:
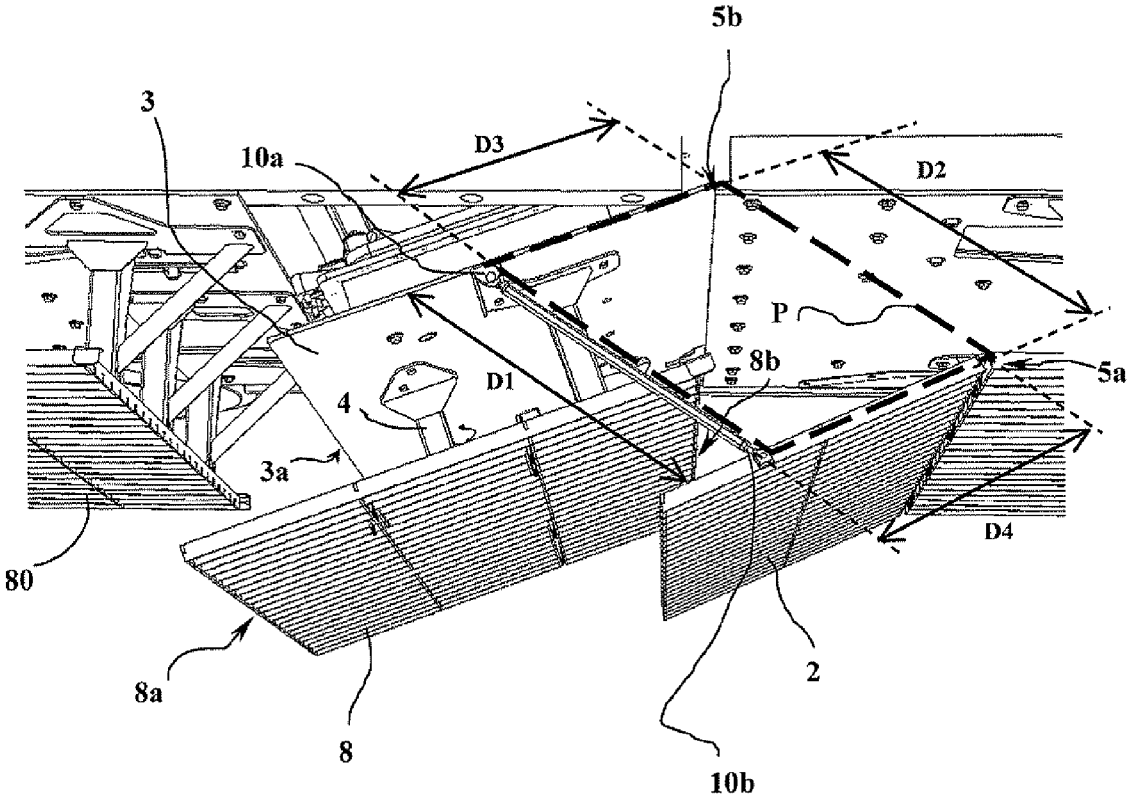
FIG. 3 shows a partial top view of an armored vehicle with one partially opened door equipped with a protective device according to the first embodiment of the invention.
Figure 4:
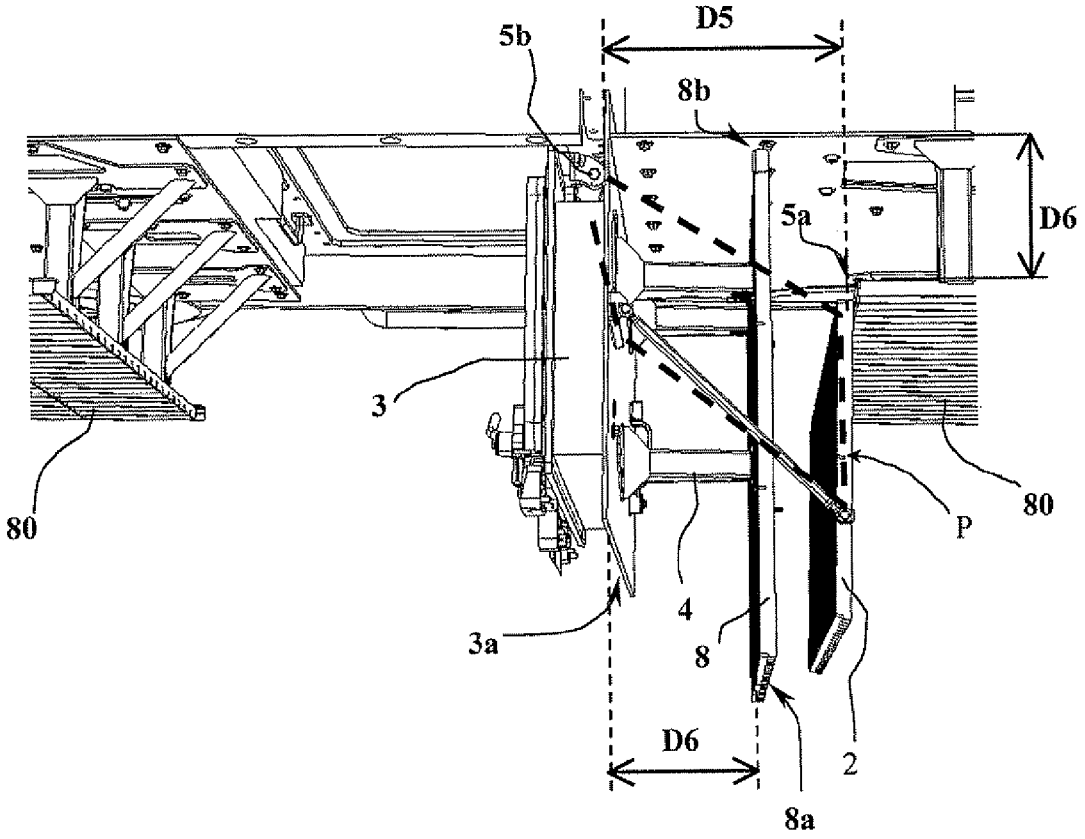
FIG. 4 shows a partial top view of an armored vehicle with a fully opened door equipped with a protective device according to the first embodiment of the invention.
Figure 5:
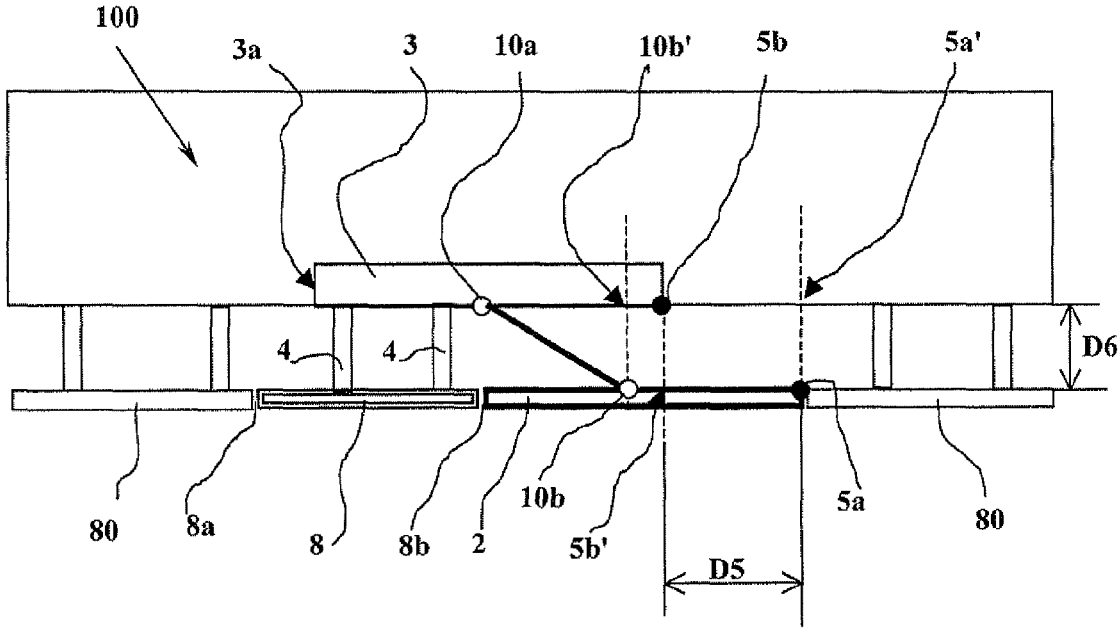
FIG. 5 shows a partial top view of an armored vehicle, doors closed, equipped with a protective device according to the first embodiment of the invention.

According to one embodiment of the invention shown in FIGS. 1 to 5, the vehicle 100 incorporates a fixed panel 8 on and made integral with a door 3 by means of arms 4 (see also FIGS. 3, 4 and 5).

In the prolongation of the fixed panel 8 there is a mobile panel 2. The fixed panel 8 and mobile panel 2 are contiguous by one of their sides (second lateral edge 8*b* of the fixed panel 8) but are not joined together. The mobile panel 2 is linked to the rest of the stand-off protection by hinges 5 enabling it to pivot around a vertical axis 5*a*. This vertical axis 5*a* is parallel to the axis of rotation 5*b* of the door 3. A connecting rod 10 links the door 3 to the mobile panel 2. The connecting rod 10 is made integral with the door 3 by a first pivot 10*a*. It is integral with the mobile panel 2 by a second pivot 10*b*.

Note in FIG. 5 that the orthogonal protection 10*b*' of the axis of the second pivot 10*b* on the plane of the door 3 is located between the first pivot 10*a* and the orthogonal projection 5*a*' on the plane of the door 3 of the axis of rotation 5*a* of the hinges of the mobile panel 2. Note also that the axis of rotation 5*b* of the door 3 is located facing the mobile panel 2, which means that the orthogonal projection 5*b*' of this axis 5*b* on the plane of the mobile panel 2 is effectively in the mobile panel 2.

These conditions are necessary for the door 3 and the mobile panel 2 to be opened without interfering with one another. Still in the aim of avoiding interference, the external edge 3*a* of the door 3, which is parallel to the axis of rotation 5*b* of the door, is facing the fixed panel 8 integral with the door 3. The first lateral edge 8*a* of the fixed panel 8 thus extends laterally beyond the external edge 3*a* of the door.

Thus, the door 3 does not interfere with a neighboring panel 80, fixed with respect to the vehicle, when the door 3 carrying the fixed panel 8 is opened.

These characteristics thereby enable the onboard crew to be able to simultaneously close or open the door 3 and fixed 8 and mobile 2 protection panels from the inside of the vehicle whilst taking advantage of a full protection of the door 3 once this is closed.

With reference to FIG. 2, the fixed panel 8 incorporates a hatch 11 mounted on hinges and located facing unlocking means 12 for the door 3 that incorporate a handle 13. This hatch provides access to the unlocking means 12 and namely to the handle 13 of the door 3 from the exterior of the vehicle and without the need for help from the crew inside the vehicle.

FIG. 3 shows the door 3 half-open. A quadrilateral P is shown in this Figure whose summit angles are the pivots 10*a* and 10*b* and the ends of the axes of rotation 5*a* and 5*b*. This quadrilateral is a deformable parallelogram P. Thus, the distance D1 between the pivots 10*a* and 10*b* is substantially equal to the distance D2 between the axes of rotation 5*a* and 5*b*. Furthermore, as the protection device 8 is parallel to the door 3, the distance D3 between the axis of rotation 5*b* of the door 3 and, the first pivot 10*a* is also substantially equal to the distance D4 between the second pivot 10*b* and the axis of rotation 5*a* of the hinges of the mobile panel 2.

These characteristics enable the parallelism to be maintained between the door 3 and mobile panel 2 for all the opening angles of the door 3.

FIG. 4 shows the door 3 fully open. Note that, for it to be possible to open the door 3 without any interference, the fixed panel 8 must, in this open position, be positioned between the door 3 and the mobile panel 2. This is possible if the distance D5 between the axis of rotation 5*b* of the door 3 and the plane of the mobile panel 2 in this open position is greater than the distance D6 between the protection device and the walls of the vehicle. This distance D5 is also marked out in FIG. 5 where the device can be seen doors closed. It is by construction the distance between the axis of rotation 5*b* of the door 3 and the orthogonal projection 5*a*' on the plane of the closed door 3 of the axis of rotation 5*a* of the hinges of the mobile panel 2.

What is claimed is:

1. A standoff protection device covering a door, the standoff protection device comprising:

a mobile panel hinged on hinges, the mobile panel having an axis of rotation about the hinges parallel to an axis of rotation of the door covered by the standoff protection device;

a connecting rod linking the door to the mobile panel, the connecting rod being linked to the door by a first pivot and linked to the mobile panel by a second pivot, an orthogonal projection of an axis of the second pivot on a plane defined by the door being located between the first pivot and an orthogonal projection of the axis of rotation of the mobile panel on the plane of the door, the mobile panel being positioned facing the axis of rotation of the door; and a fixed standoff protective panel integral with the door, the fixed panel having a first lateral edge extending beyond an external edge of the door parallel the door's axis of rotation, and having a second lateral edge contiguous with the mobile panel when the door is closed.

2. A standoff protection device according to claim 1, wherein a distance between the first pivot and the axis of rotation of the door is substantially equal to a distance between the second pivot and the axis of rotation of the mobile panel.

3. A standoff protection device according to claim 2, wherein when the fixed standoff protective panel is disposed facing a handle of the door, the fixed standoff protective panel includes an access hatch to access the handle.

4. A standoff protection device according to claim 2, where a distance between the axis of rotation of the door and an orthogonal projection of the axis of rotation of the mobile panel on the plane of the door panel is greater than a distance separating the mobile panel from the door.

5. A standoff protection device according to claim 1, wherein when the fixed standoff protective panel is disposed facing a handle of the door, the fixed standoff protective panel includes an access hatch to access the handle.

6. A standoff protection device according to claim 1, wherein a distance between the axis of rotation of the door and an orthogonal projection of the axis of rotation of the mobile panel on the plane of the door is greater than a distance separating the mobile panel from the door.

* * * * *